US008327783B2

(12) United States Patent
Son et al.

(10) Patent No.: US 8,327,783 B2
(45) Date of Patent: Dec. 11, 2012

(54) MOONPOOL AND DRILLSHIP HAVING THE SAME

(75) Inventors: Hye-Jong Son, Daejeon (KR); Su-Hyung Kim, Daejeon (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 0 days.

(21) Appl. No.: 13/092,520

(22) Filed: Apr. 22, 2011

(65) Prior Publication Data

US 2011/0197802 A1 Aug. 18, 2011

Related U.S. Application Data

(63) Continuation of application No. PCT/KR2009/005703, filed on Oct. 6, 2009.

(30) Foreign Application Priority Data

Oct. 27, 2008 (KR) ..... 10-2008-0105224
Dec. 11, 2008 (KR) ..... 10-2008-0125800
Sep. 28, 2009 (KR) ..... 10-2009-0091728

(51) Int. Cl.
*B63B 3/00* (2006.01)
*B63B 39/00* (2006.01)
*B63B 35/44* (2006.01)

(52) U.S. Cl. ..... 114/65 R; 114/264; 114/122

(58) Field of Classification Search ..... 114/65 R, 114/121, 122, 125, 264, 266
See application file for complete search history.

(56) References Cited

U.S. PATENT DOCUMENTS 3,109,403 A * 11/1963 Ripley ..... 114/125
3,160,136 A * 12/1964 Ripley ..... 114/125
6,155,193 A * 12/2000 Syvertsen et al. ..... 114/230.12
6,220,194 B1 * 4/2001 Kjersem ..... 114/121
7,918,174 B2 * 4/2011 Ahn et al. ..... 114/65 R
8,079,321 B2 * 12/2011 Balasubramanian ..... 114/74 R

FOREIGN PATENT DOCUMENTS

GB 2356174 A * 5/2001

* cited by examiner

*Primary Examiner* — Stephen Avila
*Assistant Examiner* — Andrew Polay
(74) *Attorney, Agent, or Firm* — Brinks Hofer Gilson & Lione

(57) ABSTRACT

The moonpool includes a first space formed by being penetrated from a bottom surface through an upper deck of the drillship so as to carry out a drilling operation; and a second space formed on a side of the first space in a lengthwise direction of the drillship, a bottom of the second space being open toward a lower side of the drillship. The second space is formed on a side of the first space in the lengthwise direction of the drillship so that the overall length of the moonpool is increased.

12 Claims, 11 Drawing Sheets

MOONPOOL AND DRILLSHIP HAVING THE SAME

PRIORITY CLAIM

This application is a continuation and claims the benefit of priority under 35 U.S.C. §§120, 365, and 371 to Patent Cooperation Treaty Patent Application No. PCT/KR2009/005703, filed on Oct. 6, 2009. This application further claims the benefit of priority to Korean Application Nos. 10-2008-0105224 filed Oct. 27, 2008, 10-2008-0125800 filed Dec. 11, 2008, and 10-2009-0091728 filed Sep. 28, 2009. The disclosures of the above applications are incorporated herein by reference in their entireties.

TECHNICAL FIELD

The present invention relates to a moonpool and a drillship having the moonpool, more specifically to a moonpool and a drillship having the moonpool that has a modified moonpool structure to reduce vibrations and resistance caused by the flow of seawater inside the moonpool during the sailing of the drillship.

BACKGROUND

With the rapid industrial and manufacturing development in the global scale, use of fossil fuels, such as petroleum, has been increased, and international oil prices have been steadily soaring. Accordingly, stable production and supply of crude oil has become an increasingly important issue.

For this reason, petty deep sea oil fields, which have been neglected until recently for their technical difficulties of drilling and lack of economic feasibility, have begun to receive attention, and ships having drilling equipment fitted for oil field development have been developed in step with the development of resource development technologies.

For the conventional sea drilling equipment, a rig ship or a fixed-type platform have been commonly used, which can be moved by another tugboat and carries out its drilling operation while being fixed at a location in the sea by mooring equipment.

Developed and used more recently for deep sea drilling is a drillship, which is closer to an ordinary vessel with the state-of-the-art drilling equipment and can sail with its own locomotive power. Such drillship needs to be designed to have optimal sailing capacities as well as drilling capabilities because it needs to frequently move its location for the development of petty oil fields.

The drillship is installed with a large opening (referred to as "moonpool" hereinafter) for lowering a drilling pipe. Although this structure is indispensably essential for the use of the drillship, this structure is very disadvantageous in terms of the sailing speed.

In other words, due to periodic oscillation of the water surface inside the moonpool caused by the relative movement between the seawater flowed in and out of the moonpool and the seawater outside the hull, and the resulting movement of the hull, resistance is increased during the sailing of the drillship, resulting in the reduced speed and more fuel consumption. It has been observed that this resistance is increased by as much as 50%.

To date, designed and utilized for the purpose of reducing such increase of resistance have been affixture affixed inside the moonpool, affixture on the bottom of the ship around the moonpool, movable opening/closing devices inside the moonpool, etc. However, the affixture inside the moonpool has a complicated structure compared to its effect, and the movable opening/closing device is not widely used because its cost for installation and maintenance is very high.

Contrived to solve the above problems, the present invention provides a moonpool and a drillship having the moonpool that can reduce the resonance and resistance caused by the vertical movement of the seawater inside the moonpool while the drillship is sailing.

The present invention also provides a moonpool and a drillship having the moonpool that can reduce the amplitude of a sloshing movement and the resistance caused by the sloshing movement of the seawater inside the moonpool while the drillship is sailing.

SUMMARY

An aspect of the present invention features a moonpool formed in a drillship that includes: a first space formed by being penetrated from a bottom surface through an upper deck of the drillship so as to carry out a drilling operation; and a second space formed on a side of the first space in a lengthwise direction of the drillship, a bottom of the second space being open toward a lower side of the drillship.

A maximum length and a maximum width of a transverse section of the second space can be smaller than a maximum length and a maximum width of a transverse section of the first space.

The moonpool can include a partition wall, which is formed between the first space and the second space. An upper line of the partition wall can be formed at a predetermined height from a bottom surface of the drillship in such a way that the seawater flowed into the first space can flow into the second space.

The upper line of the partition wall can be formed between two meters below a water line of the drillship and two meters above the water line of the drillship.

Perforations can be formed in the partition wall.

The second space can be formed at least at one of a stern side and a bow side of the first space in a lengthwise direction of the drillship.

An upper surface of the second space can be open toward an upper side of the drillship.

A transverse section of the first space and the second space respectively can have the shape of a quadrangle that is extended in a lengthwise direction of the drillship.

A transverse width of the second space that is perpendicular to the lengthwise direction of the drillship can be formed to be smaller than a transverse width of the first space.

A length of the second space that is extended in the lengthwise direction of the drillship can be formed to be smaller than a length of the first space.

The length of the second space can be 10% to 50% of the length of the first space.

An opening opened toward a lower side of the first space can maintain a constant transverse width and then become narrower in a stern-side direction of the drillship.

A baseplate that is placed on a same plane as a bottom surface of the drillship can be installed on both corners of an end of the opening opened toward the lower side of the first space, wherein the both corners of the end are located in a stern-side direction of the drillship and the baseplate has the shape of a triangle.

A transverse section of the second space can have the shape of a semi-circle or a polygon.

Another aspect of the present invention features a drillship having the moonpool described above.

According to the present invention, a second space is formed on a side of a first space in the lengthwise direction of a drillship so that the overall length of a moonpool is increased. Therefore, vertical movements of the water surface inside the moonpool can be changed, and the amplitude of the water surface movement inside the moonpool and the resistance of the drillship can be reduced.

Moreover, by installing a partition wall having a particular upper line height between the first space and the second space, the amplitude of sloshing movements of the water surface inside the moonpool can be reduced, and the resistance caused by the sloshing movements can be reduced.

Furthermore, by forming an opening opened toward a lower side of the first space to maintain a constant transverse width and become narrower in a stern-side direction of the drillship, the amount of seawater flowed into the first space can be relatively reduced, and the resistance applied to the drillship can be reduced.

BRIEF DESCRIPTIONS OF THE DRAWINGS

Figure 4:
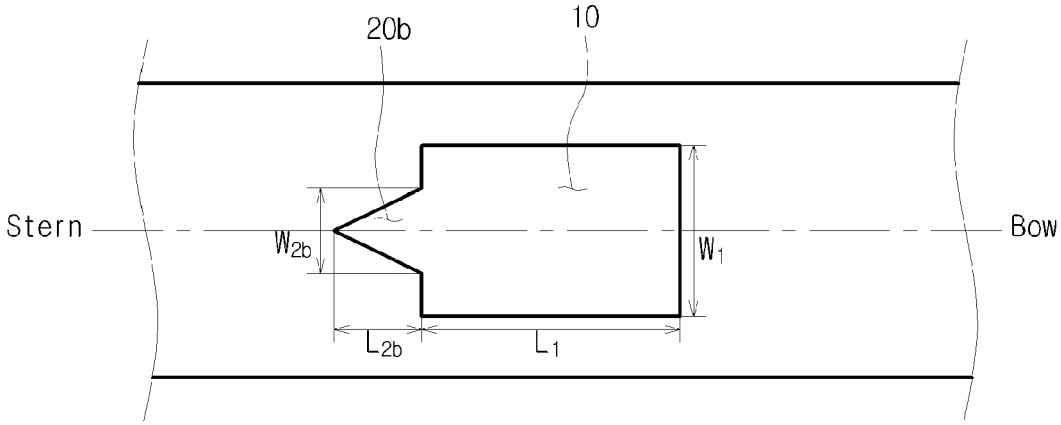
Figure 5:
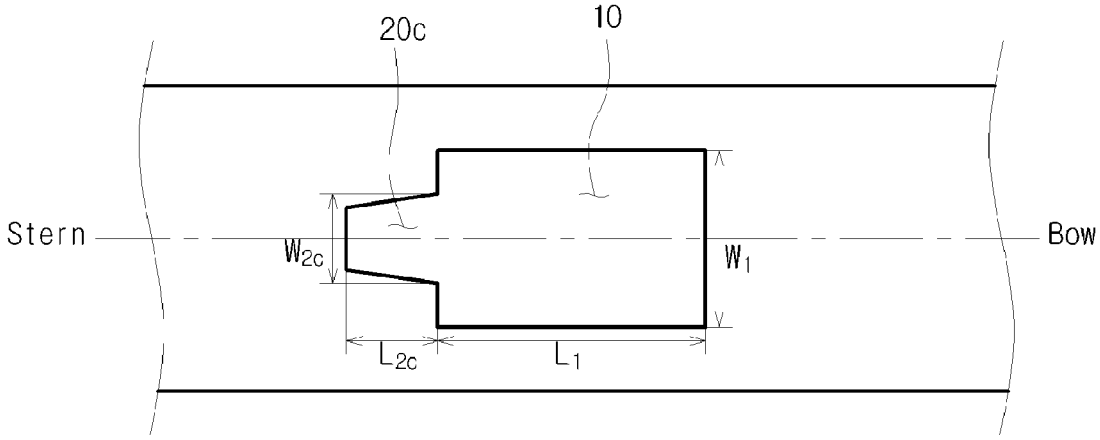
Figure 6:
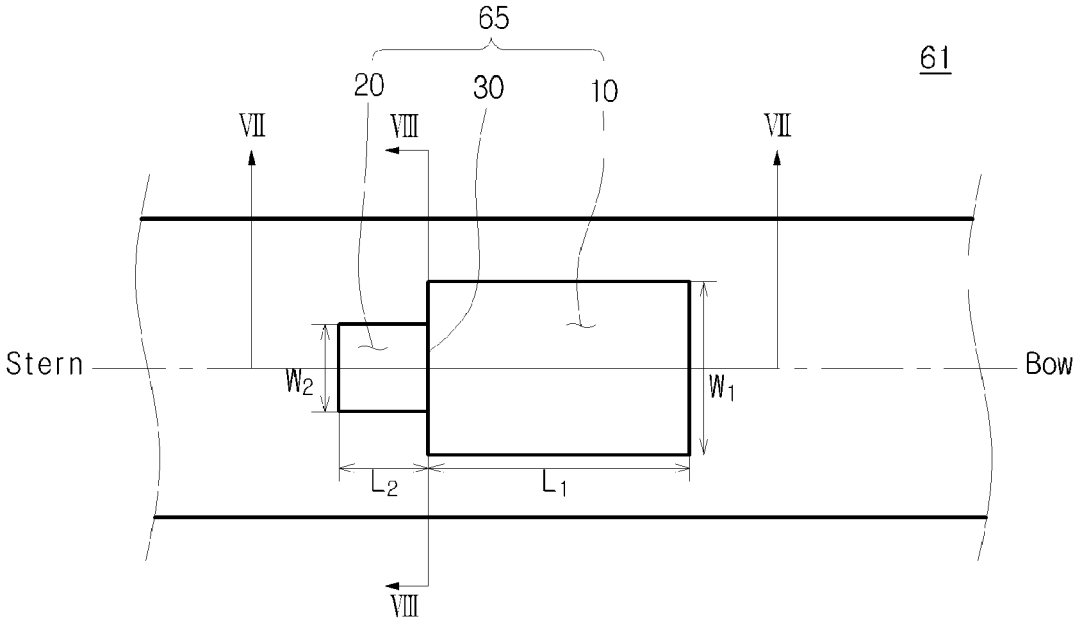

FIG. 4 shows another modification example of a second space included in the moonpool in accordance with the first embodiment of the present invention FIG. 5 shows yet another modification example of a second space included in the moonpool in accordance with the first embodiment of the present invention FIG. 6 is a plan view of a moonpool in accordance with a second embodiment of the present invention.

Figure 7:
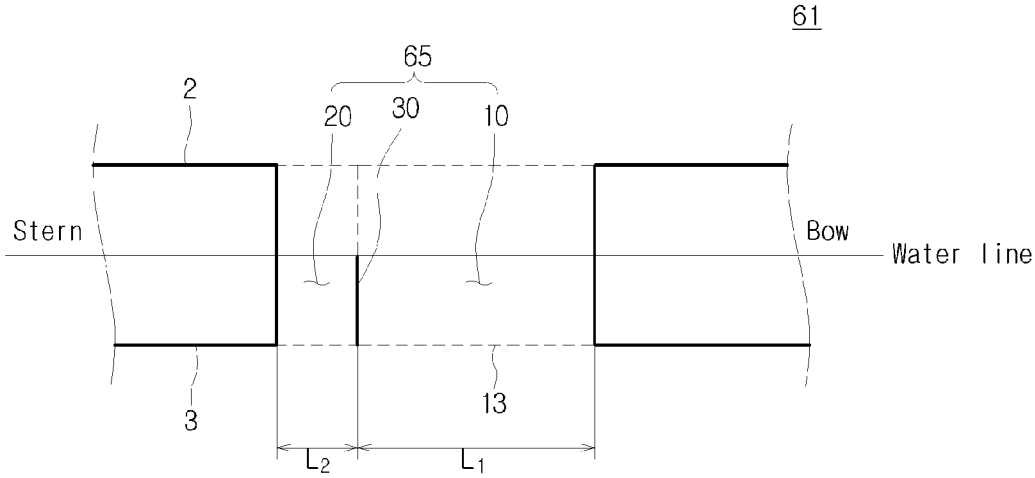

FIG. 7 is a cross-sectional view of FIG. 6 seen along the VII-VII line.

Figure 8:
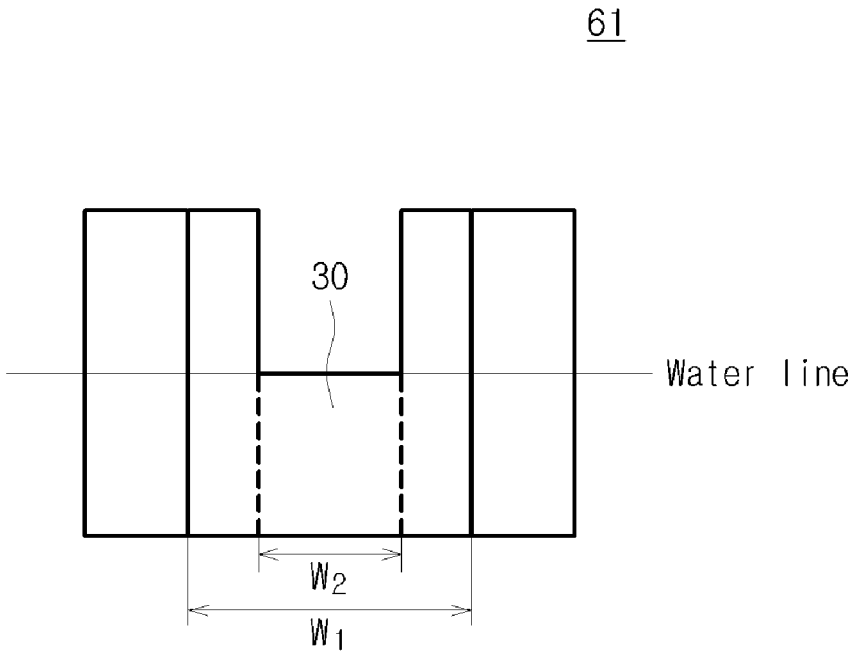

FIG. 8 is a cross-sectional view of FIG. 6 seen along the VIII-VIII line.

Figure 9:
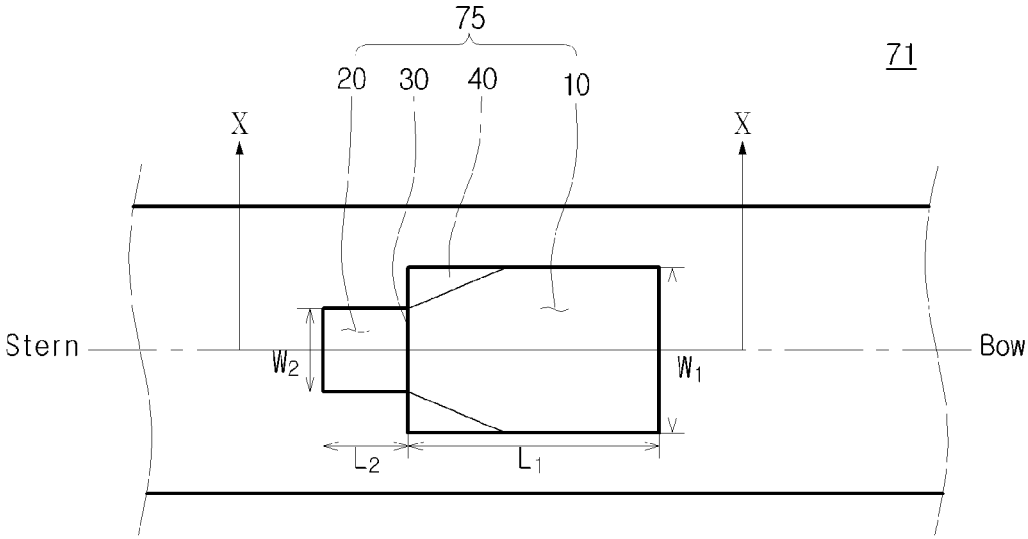

FIG. 9 is a plan view of a moonpool in accordance with a third embodiment of the present invention.

Figure 10:
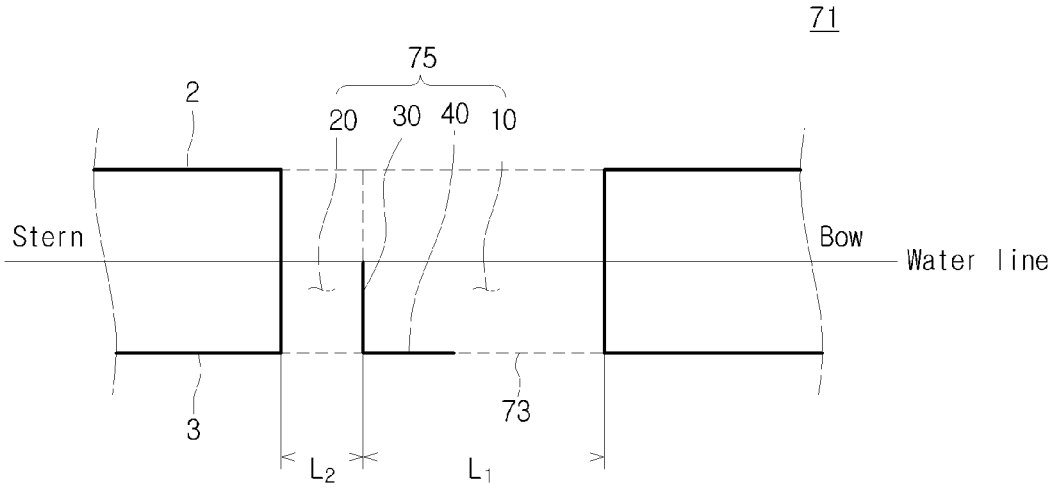

FIG. 10 is a cross-sectional view of FIG. 9 seen along the X-X line.

Figure 11:
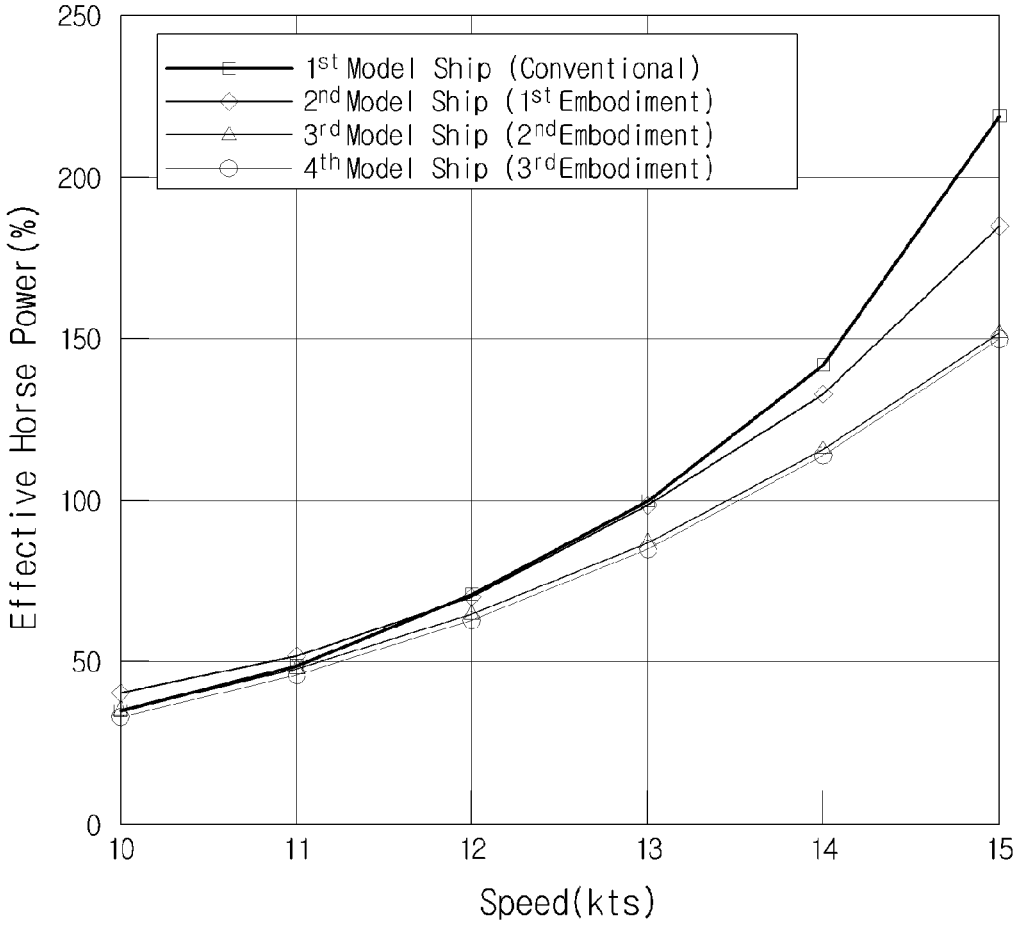

FIG. 11 shows the result of a towing experiment of model ships in which moonpools in accordance with the embodiments of the present invention are formed.

DETAILED DESCRIPTION OF THE PREFERRED EMBODIMENTS

Hereinafter, certain embodiments of the present invention will be described with reference to the accompanying drawings.

Figure 1:
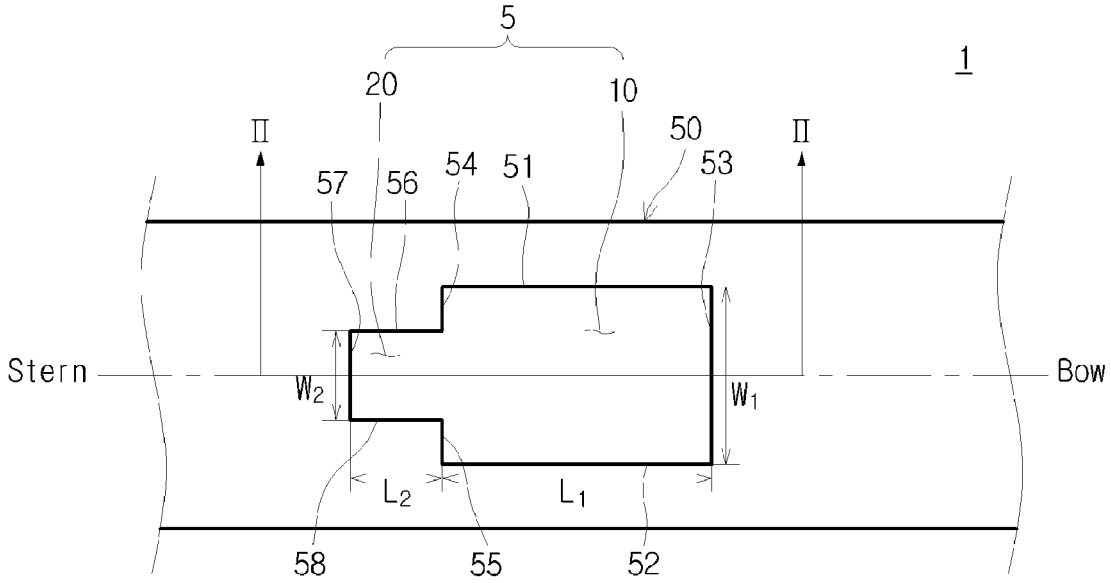
FIG. 1 is a plan view of a moonpool in accordance with a first embodiment of the present invention.
Figure 2:
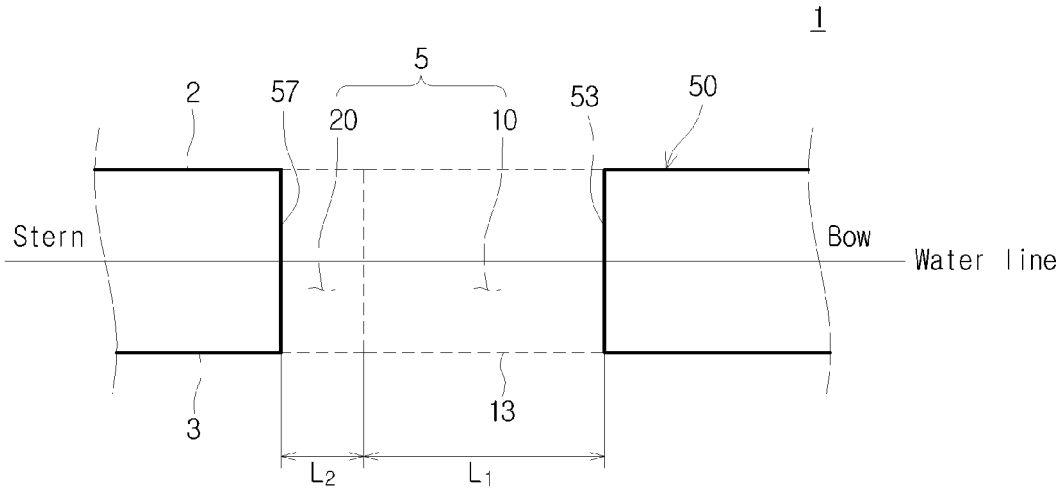
FIG. 2 is a cross-sectional view of FIG. 1 seen along the II-II line.

FIG. 1 is a plan view of a moonpool in accordance with a first embodiment of the present invention, and FIG. 2 is a cross-sectional view of FIG. 1 seen along the II-II line.

Referring to FIGS. 1 and 2, a moonpool 5 in accordance with a first embodiment of the present invention is formed between a bow and a stern of a drillship 1, and includes a first space 10 for carrying out a drilling operation and a second space 20 formed adjacent to the first space 10.

The first space 10 is formed by penetrating an upper deck 2 from a bottom surface 3 of the drillship 1. In this case, the first space 10 can be vertically formed from the bottom surface 3 of the drillship 1, and the first space 10 can be limited by inner walls 51, 52, 53, 54, 55 that are extended vertically in a hull 50 of the drillship 1.

Referring to FIG. 1, the transverse section of the first space 10 is shaped to be a quadrangle such as, for example, a rectangle that is extended in a lengthwise direction of the drillship. In this case, the transverse section of the first space 10 is symmetric about a center line from the bow to the stern of the drillship 1. The first space 10 formed as described above can be used as a pathway to lower a drilling device (not shown), a drilling pipe (not shown), etc. to the seabed.

An opening 13 opened to a lower side of the first space 10 in accordance with the first embodiment of the present invention is shaped to be a quadrangle such as, for example, a rectangle that is extended in a lengthwise direction of the drill ship.

However, it shall be appreciated that the shape of the first space 10 in accordance with the first embodiment of the present invention is only an example, and a variety of shapes can be used as long as the first space 10 can be used as a pathway for carrying out a drilling operation.

A second space 20 is formed on a side of the first space 10 in the lengthwise direction of the drillship. In this case, referring to FIG. 2, a bottom of the second space 20 is formed to be open toward a lower side of the drillship 1, and the second space 20 can be limited by inner walls 56, 57, 58 extended vertically in the hull 50 of the drillship 1.

Through the opening of the second space 20 formed as described above, the seawater can be flowed in and out of the second space 20. In this case, an upper surface of the second space 20 can be opened toward an upper side of the drillship.

Referring to FIG. 1, the transverse section of the second space 20 is shaped to be a quadrangle that is extended in a lengthwise direction of the drillship. In this case, the transverse section of the second space 20 is symmetric about a center line from the bow to the stern of the drillship 1.

Moreover, the second space 20 is formed to be in contact with a rear side of the first space 10 (i.e., the stern side of the first space 10 in the drillship 1). Here, it is possible that the second space 20 is formed in contact with a front side of the first space 10 (i.e., the bow side of the first space 10 in the drillship 1), and it is also possible that the second space 20 is formed on both sides of the first space 10 in the lengthwise direction of the drillship, that is, the bow side and the stern side of the first space 10.

Accordingly, compared to a moonpool having only the first space 10 formed therein (referred to as "conventional moonpool" hereinafter), the length of the moonpool 5 (the length in the bow-stern direction of the drillship 1 in FIG. 1) in accordance with the first embodiment of the present invention is increased.

This increase of length changes a movement pattern of the seawater occurring in the conventional moonpool. More specifically, in the moonpool 5 in accordance with the first embodiment of the present invention that is relatively longer, vertical movements of the seawater that predominantly occurred in the conventional moonpool are reduced, and instead sloshing movements predominantly occur.

Here, since the vertical movements of the water surface inside the moonpool cause greater resistance to the drillship than the sloshing movements do, the moonpool 5 in accordance with the first embodiment of the present invention can give less resistance to the drillship 1 than the conventional moonpool.

According to the first embodiment, a length L2 of the second space 20 is formed to be smaller than a length L1 of the first space 10. In this case, it is preferable that the length L2 of the second space 20 is between 10% and 50% of the length L1 of the first space 10.

If the length L2 of the second space 20 becomes excessively great, the area of the opening of the moonpool 5 becomes excessively great, adversely increasing the resistance occurring while the drillship 1 is sailing. Therefore, it is preferable that the length of the second space 20 is small compared to the length of the first space 10.

It is preferable that a width W2 of the second space 20 is smaller than a width W1 of the first space 10. If the width W2 of the second space 20 is greater than or equal to the width W1 of the first space 10, the area of the opening is excessively increased, adversely increasing the occurred resistance due to the seawater flowed into the moonpool of the drillship.

The second space 20 in accordance with the first embodiment of the present invention has a quadrangular sectional shape with a smaller length and width than the first space 10. However, this is only an example, and the second space 20 can have a variety of shapes as long as the maximum sectional length and maximum sectional width of the second space 20 are smaller than the sectional length and sectional width of the first space 10, respectively.

Figure 3:
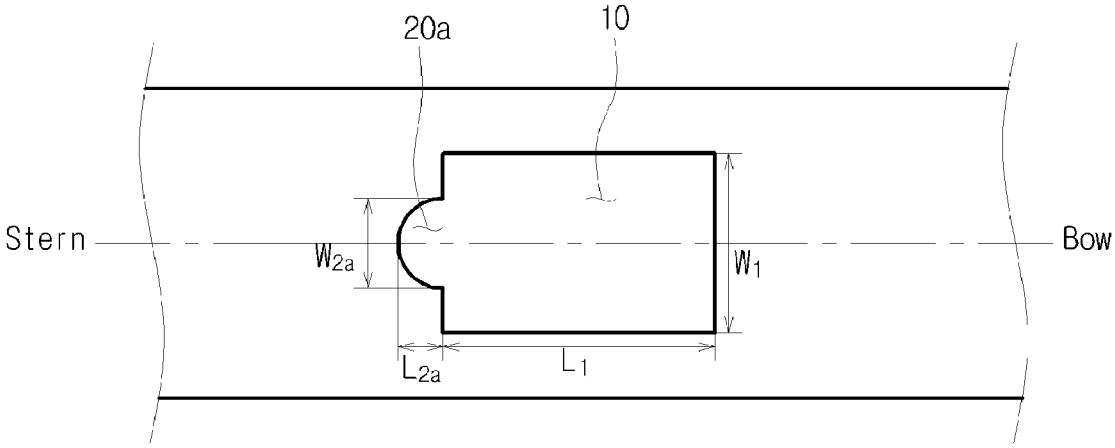
FIG. 3 shows a modification example of a second space included in the moonpool in accordance with the first embodiment of the present invention.

In this regard, FIG. 3 to FIG. 5 show modification examples of the second space included in the moonpool in accordance with the first embodiment of the present invention.

Referring to FIG. 3, a transverse section of a second space 20*a* can have the shape of a semi-circle. Here, the shape of a semi-circle can include the shape of a semi-ellipse. In this case, a maximum length L2*a* and a maximum width W2*a* of the transverse section of the second space 20*a* are smaller than a maximum length L1 and a maximum width W1 of the transverse section of the first space 10, respectively.

The transverse section of the second space can have the shape of a polygon. For example, as it can be seen in FIG. 4, a transverse section of a second space 20*b* can have the shape of a triangle. In this case, a maximum length L2*b* and a maximum width W2*b* of the transverse section of the second space 20*b* are smaller than the maximum length L1 and the maximum width W1 of the transverse section of the first space 10, respectively.

Alternatively, as it can be seen in FIG. 5, a transverse section of a second space 20*c* can have the shape of a trapezoid. In this case, a maximum length L2*c* and a maximum width W2*c* of the transverse section of the second space 20*c* are smaller than the maximum length L1 and the maximum width W1 of the transverse section of the first space 10, respectively.

FIG. 6 is a plan view of a moonpool in accordance with a second embodiment of the present invention. FIG. 7 is a cross-sectional view of FIG. 6 seen along the VII-VII line, and FIG. 8 is a cross-sectional view of FIG. 6 seen along the VIII-VIII line. Referring to FIG. 6 to FIG. 8, a moonpool 65 in accordance with a second embodiment of the present invention is formed between a bow and a stern of a drillship 61, and includes a first space 10 for carrying out a drilling operation, a second space 20 formed adjacent to the first space 10 and a partition wall 30 formed between the first space 10 and the second space 20.

Here, any elements that are identical to those described with reference to the first embodiment will not be described, and unless described specifically, these elements will be considered to be identical to those of the first embodiment, and the description thereof will be substituted by the description provided with reference to the first embodiment. Hereinafter, the elements peculiar to the second embodiment of the present invention will be mainly described.

According to the second embodiment of the present invention, the partition wall 30 is installed between the second space 20 and the first space 10. The partition wall 30 is installed in order to partition the entire length of the moonpool 65 into certain lengths.

Accordingly, sloshing movements with a big amplitude that occurs in a relatively long (i.e., L1+L2) space can be changed to sloshing movements with a small amplitude in a relatively short (i.e., L1 and L2, respectively) space due to the presence of the partition wall.

In this case, the partition wall 30 is formed in such a way that the seawater inside the first space 10 can flow to the second space 20. To that end, according to the second embodiment, the partition wall 30 is formed in such a way that its upper line is placed at a predetermined_height from the bottom surface 3 of the drillship 61.

With respect to the installation height of the partition wall with reference to FIGS. 7 and 8, the partition wall 30 is formed in such a way that the upper line of the partition wall 30 is extended to a water line of the drillship 61. In this case, the upper line of the partition wall 30 can be placed between two meters below the water line and two meters above the water line.

It shall be appreciated, however, that the shape of the partition wall 30 in accordance with the second embodiment of the present invention is an example only and that the partition wall can be modified in various ways as long as it can reduce the resistance occurred in the drillship pursuant to the seawater in the first space 10 flowing over the upper line of the partition wall 30 to the second space 20.

Moreover, the partition wall 30 can be formed with perforations, through which the seawater in the first space 10 and the second space 20 can respectively flow in and out of the second space 20 and the first space 10.

FIG. 9 is a plan view of a moonpool in accordance with a third embodiment of the present invention, and FIG. 10 is a cross-sectional view of FIG. 9 seen along the X-X line. Hereinafter, the elements peculiar to the third embodiment will be mainly described. Here, any elements that are identical to those described with reference to the first and second embodiments will not be described, and unless described specifically, these elements will be considered to be identical to those of the first and second embodiments, and the description thereof will be substituted by the description provided with reference to the first and second embodiments.

Referring to FIGS. 9 and 10, the transverse section of a first space 10 in accordance with a third embodiment of the present invention is shaped to be a quadrangle, for example, a rectangle, that is extended in a lengthwise direction of a drillship 71.

In this case, an opening 73 that is opened toward a lower side of the first space 10 is formed to keep a fixed transverse width and become narrower toward a stern of the drillship 71. To that end, in the third embodiment of the present invention, a baseplate 40 that is placed on the same plane as a bottom surface 3 of the drillship 71 is installed on both corners of a rear-side end (i.e., an end part located in the stern-side direction of the drillship 71) of the opening 73, which is opened toward the lower side of the first space 10. Here, the baseplate 40 can have the shape of a triangle.

As such, by forming the opening 73 that is opened toward the lower side of the first space 10 to become gradually narrower along the moving direction of the seawater that moves from the bow to the stern of the drillship 71 when the drillship sails forward, the amount of the seawater that flows into the first space 10 becomes relatively reduced, thereby reducing the resistance applied to the drillship 71.

The size and shape of the opening 73 opened toward the lower side of the first space 10 shall be determined in such a way that a drilling pipe, etc. that are descended toward the seabed are not interfered. The size of the baseplate 40 shall be also determined in the same respect.

FIG. 11 shows the result of a towing tank experiment of model ships in which moonpools in accordance with the embodiments of the present invention are formed. Illustrated in FIG. 11 are results on the relations between speed and effective horsepower by conducting an experiment in a towing tank with a model ship in which the conventional moonpool (having the first space only) is formed (referred to as the "first model ship" hereinafter), a model ship in which the moonpool in accordance with the first embodiment of the present invention (having the first space and the second space only) is formed (referred to as the "second model ship" hereinafter),_a model ship in which the moonpool in accordance with the second embodiment of the present invention (having the partition wall between the first space and the second space, the opening toward the lower side of the first space having a quadrangular shape) is formed (referred to as the "third model ship" hereinafter), and a model ship in which the moonpool in accordance with the third embodiment of the present invention (having the partition wall between the first space and the second space, the opening toward the lower side of the first space maintaining a fixed width and becoming narrower in the stern-side direction) is formed (referred to as the "fourth model ship" hereinafter). Here, the values indicated in the effective horsepower axis refer to relative values with an assumption that the effective horsepower required to tow the first model ship with 13 kts is 100.

Describing the experiment results by referring to FIG. 11, it can be seen that when the first model ship (with the conventional moonpool) and the second model ship (with the first embodiment) are compared, the second model ship has approximately 4% less resistance than the first model ship at the speed of 13 kts. This means that the second model ship can sail with less engine horsepower than the first model ship at the same sailing speed.

This trend is more prominent when the speed of the model ships is greater. For example, at the speed of 15 kts, the resistance is decreased by about 16%. This means that the second model ship can sail with a significantly less engine horse power than the first model ship at the sailing speed of 15 kts.

As such, the second model ship can sail with less engine horse power at a particular speed because the resistance occurred during the sailing is less than the first model ship.

Comparing the first model ship (with the conventional moonpool) with the third model ship (with the second embodiment) referring to FIG. 11, it can be seen that the third model ship has approximately 10% less resistance than the first model ship at the speed of 13 kts. This means that the third model ship can sail with less engine horse power than the first model ship at the same sailing speed.

This trend is more prominent when the speed of the model ships is greater. For example, at the speed of 15 kts, the resistance is decreased by about 30%. This means that the third model ship can sail with a significantly less engine horse power than the first model ship at the sailing speed of 15 kts.

As such, the third model ship can sail with less engine horse power at a particular speed because the resistance occurred during the sailing is less than the first model ship.

Comparing the third model ship (with the second embodiment) with the fourth model ship (with the third embodiment) referring to FIG. 11, it can be seen that the fourth model ship has approximately 3% less resistance than the third model ship in the entire range of sailing speeds. This means that the fourth model ship can sail with relatively less fuel than the third model ship at any particular sailing speed.

While some embodiments of the present invention have been described above, the technical ideas of the present invention are not restricted to the embodiments presented above, and it shall be appreciated that anyone skilled in the art to which the present invention pertains can present a variety of other embodiments by supplementing, modifying, deleting and adding the elements within the scope of the same technical ideas, but such varieties shall be considered to be included in the scope of technical ideas of the present invention.

The invention claimed is:

1. A moonpool formed in a drillship, comprising:

a first space formed by being penetrated from a bottom surface through an upper deck of the drillship so as to carry out a drilling operation; and a second space formed on a side of the first space in a lengthwise direction of the drillship, a bottom of the second space being open toward a lower side of the drillship, wherein a transverse section of the first space and the second space respectively has the shape of a quadrangle that is extended in a lengthwise direction of the drillship, wherein an opening opened toward a lower side of the first space maintains a constant transverse width and then becomes narrower in a stern-side direction of the drillship, wherein a baseplate that is placed on a same plane as a bottom surface of the drillship is installed on both corners of an end of the opening opened toward the lower side of the first space, the both corner of the end located in a stern-side direction of the drillship, the baseplate having the shape of a triangle.

2. The moonpool of claim 1, wherein a maximum length and a maximum width of the transverse section of the second space are smaller than a maximum length and a maximum width of the transverse section of the first space, the transverse section being parallel to the lengthwise direction of the drillship.

3. The moonpool of claim 2, further comprising a partition wall, the partition wall formed between the first space and the second space, an upper line of the partition wall formed at a predetermined height from a bottom surface of the drillship in such a way that the seawater flowed into the first space can flow into the second space.

4. The moonpool of claim 3, wherein the upper line of the partition wall is formed between two meters below a water line of the drillship and two meters above the water line of the drillship.

5. The moonpool of claim 4, wherein perforations are formed in the partition wall.

6. The moonpool of claim 1, wherein the second space is formed at least at one of a stern side and a bow side of the first space in a lengthwise direction of the drillship.

7. The moonpool of clam 1, wherein an upper surface of the second space is open toward an upper side of the drillship.

8. The moonpool of claim 1, wherein a transverse width of the second space that is perpendicular to the lengthwise direction of the drillship is smaller than a transverse width of the first space.

9. The moonpool of claim 1, wherein a length of the second space that is extended in the lengthwise direction of the drillship is smaller than a length of the first space.

10. The moonpool of claim 8, wherein a length of the second space is 10% to 50% of a length of the first space.

11. The moonpool of claim 1, wherein a transverse section of the second space has the shape of a semi-circle or a polygon.

12. A drillship comprising:

a moonpool comprising:

a first space formed by being penetrated from a bottom surface through an upper deck of the drillship so as to carry out a drilling operation; and a second space formed on a side of the first space in a lengthwise direction of the drillship, a bottom of the second space being open toward a lower side of the drillship, wherein a transverse section of the first space and the second space respectively has the shape of a quadrangle that is extended in a lengthwise direction of the drillship, wherein an opening opened toward a lower side of the first space maintains a constant transverse width and then becomes narrower in a stern-side direction of the drillship, wherein a baseplate that is placed on a same plane as a bottom surface of the drillship is installed on both corners of an end of the opening opened toward the lower side of the first space, the both corner of the end located in a stern-side direction of the drillship, the baseplate having the shape of a triangle.

* * * * *